United States Patent [19]

Segerström

[11] Patent Number: 4,623,305

[45] Date of Patent: Nov. 18, 1986

[54] DEVICE FOR PUMPING OIL

[75] Inventor: Lars Segerström, Skärholmen, Sweden

[73] Assignee: IMO AB, Stockholm, Sweden

[21] Appl. No.: 744,039

[22] Filed: Jun. 12, 1985

[30] Foreign Application Priority Data

Jun. 20, 1984 [SE] Sweden ..... 8403316

[51] Int. Cl.[4] ..... F04B 21/00; F04B 17/00; F04C 2/18

[52] U.S. Cl. ..... 417/365; 417/424; 418/197; 418/203

[58] Field of Search ..... 417/315, 320, 325, 365, 417/410, 424; 418/203, 197

[56] References Cited

U.S. PATENT DOCUMENTS

| | | | |
|---|---|---|---|
| 1,593,820 | 7/1926 | Gates | 417/424 X |
| 2,095,167 | 10/1937 | Burghauser | 418/197 |
| 2,286,365 | 6/1942 | Lane | 417/410 X |
| 2,455,022 | 11/1948 | Schmidt | 417/410 X |
| 2,590,561 | 3/1952 | Montelius | 418/203 X |
| 2,592,476 | 4/1952 | Sennet | 418/203 X |
| 2,737,119 | 3/1956 | Hill | 417/326 |
| 3,391,643 | 7/1968 | Zalis | 418/200 |
| 4,028,025 | 6/1977 | Lonnebring | 418/203 X |
| 4,131,400 | 12/1978 | Segerstrom | 418/203 |
| 4,242,067 | 12/1980 | Segerstrom | 418/203 |
| 4,547,135 | 10/1985 | Noel et al. | 418/203 X |

FOREIGN PATENT DOCUMENTS

| | | | |
|---|---|---|---|
| 1930839 | 12/1970 | Fed. Rep. of Germany | 418/197 |
| 402029 | 12/1945 | Italy | 418/197 |
| 2023739 | 1/1980 | United Kingdom | 418/203 |

*Primary Examiner*—Carlton R. Croyle
*Assistant Examiner*—Theodore Olds
*Attorney, Agent, or Firm*—Banner, Birch, McKie & Beckett

[57] ABSTRACT

A device preferably utilized for pumping oil or other fluid from a drill hole in the ground, said device including a pump lowered into the hole and coupled to a drive motor situated under it. The pump comprises a hydraulic screw pump including a housing in which there is mounted a screw array in the form of a drive screw provided with a shaft coupled to the drive motor, and at least one running screw meshing with the drive screw. The rotational direction of the drive motor is such that the screw array pumps the liquid from an inlet, made radially in the housing and in communication with the liquid in the drill hole, to an outlet arranged at the end of the screw array remote from said shaft.

6 Claims, 2 Drawing Figures

DEVICE FOR PUMPING OIL

BACKGROUND OF THE INVENTION

1. Field of the Invention

The present invention relates to a device preferably used for pumping oil or other fluid from a drill hole in the ground, the device including a pump with a driving motor under it and connected to the pump, which are lowered into the drill hole.

The pump comprises a hydraulic screw machine including a screw array including a drive screw and at least one running screw co-acting therewith, arranged in a housing with the drive screw connected to a shaft extending outside the housing on the low pressure side of the device, the screws being provided on the low pressure side of the screw array with mutually co-acting balancing pistons adapted for hydraulically balancing the screws against axially acting forces.

2. Description of the Prior Art

In pumping such as crude oil from deep drill holes in the ground it is known to use centrifugal pumps and piston pumps lowered in the holes. The use of such pumps is associated with certain disadvantages, however. The disadvantages limiting the use of centrifugal pumps are that they have long extension in the longitudinal direction of the drill hole, since they must be provided with several stages connected in series for pumping up from great depths, and also that they have relatively poor efficiency when used for high oil viscosities. A disadvantage limiting the use of piston pumps is that they can only be used at relatively small depths since piston stroke will otherwise be unacceptably long.

Attempts have also been made to utilize screw pumps for conveying oil from drill holes, but these attempts have not been very successful, since it has been found to be very difficult to manufacture an effectively functioning pump with a radial inlet and an axial outlet at the end of the pump opposite the inlet, which is a requirement for its use as a drill hole pump.

SUMMARY OF THE INVENTION

One object of the present invention is to provide a device preferably for pumping oil or other fluid up from a drill hole in the ground, said device including a screw machine which can be used at very large depths and there take up large hydrostatic pressure, and which also can pump liquid with extremely large inlet and outlet pressures, with different viscosities and with relatively large gas content, the machine having a relatively small axial extension and a rotation of direction which may be temporarily reversed for cleaning a strainer or the like covering the inlet of the machine.

This object is achieved by the invention having been given the distinguishing features disclosed in the characterizing portions of the claims.

DETAILED DESCRIPTION OF THE PREFERRED EMBODIMENT

Figure 1:
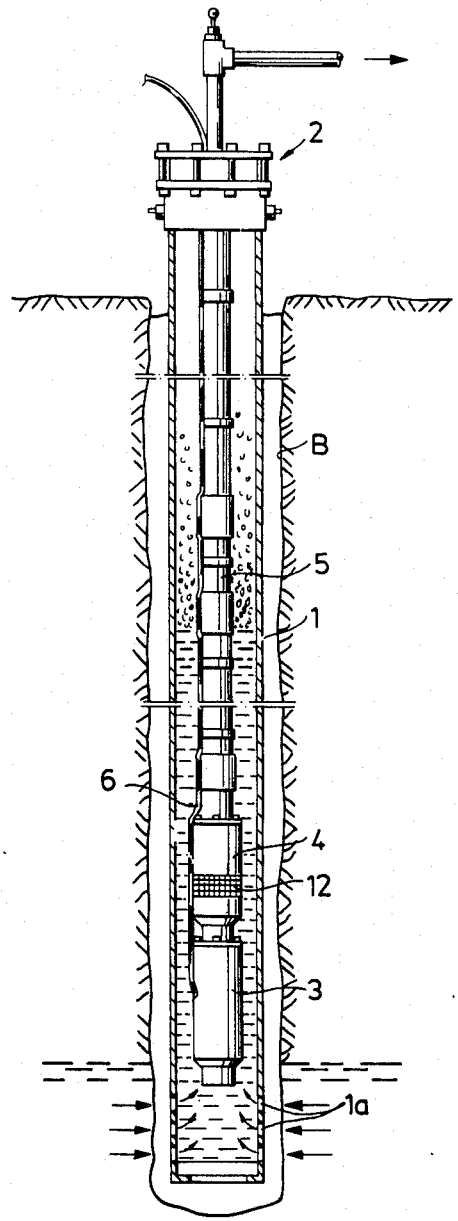
FIG. 1 is a schematic, partially cut-away side view of a device in accordance with the invention in use in a drill hole in the ground.

A drill hole made in the ground is denoted by B in FIG. 1. A typical drill hole may be 12,7 cm in diameter and 5,000 m deep. A pipe 1 is driven into the drill hole B, which is partially filled with such as crude oil and gas. Under its prevailing pressure oil is supplied to the interior of the pipe 1 via openings 1*a* at its lower end. There are means 2 at the upper end of the pipe, inter alia for pumping away oil from the drill hole and for retaining and operating the equipment used to pump oil up from the drill hole. This equipment includes an electric motor 3 with power supply from the means 2 via a cable 6, a hydraulic screw machine 4 rigidly bolted to the motor and acting as a pump, as well as a pipe string 5 bolted to the pump and consisting of a plurality of jointed pipes extending to the means 2.

Figure 2:
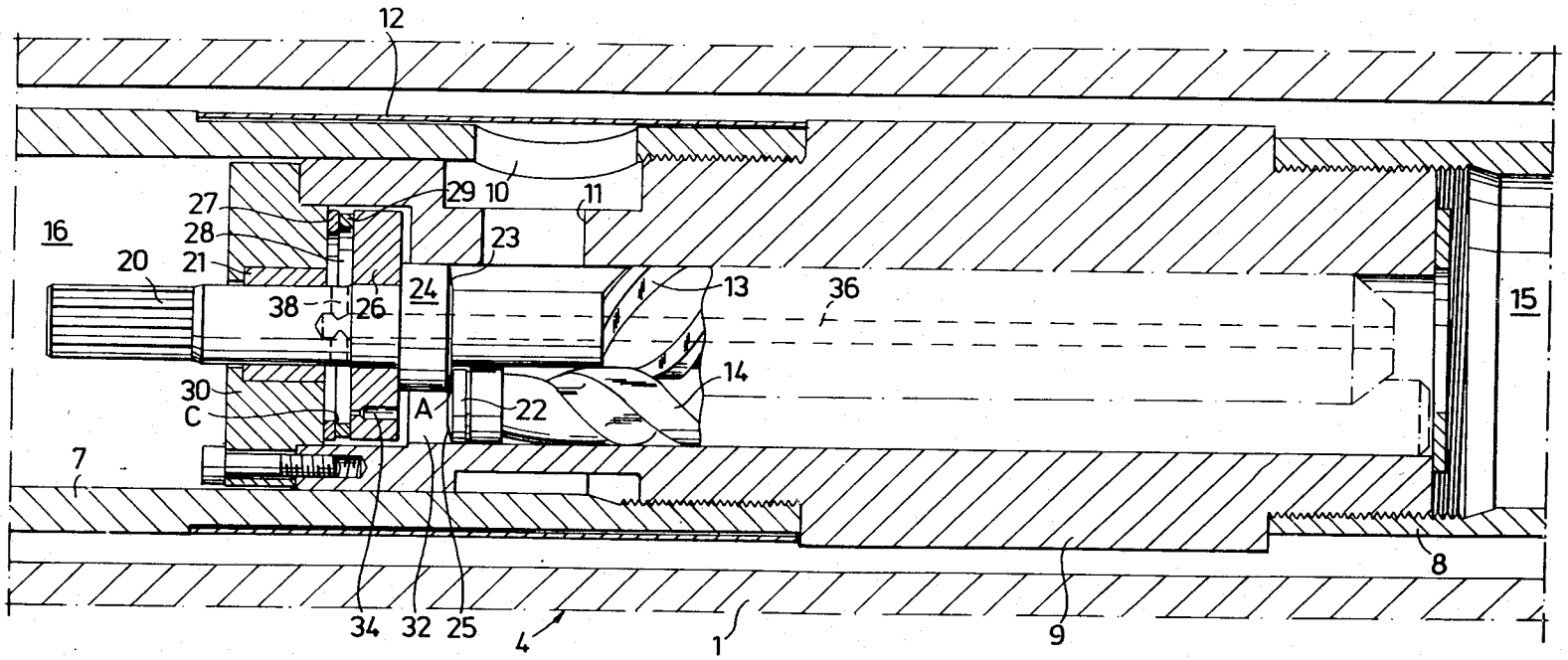
FIG. 2 is a side view, showing planes cutting each other at right angles, of a screw machine included in the device illustrated in FIG. 1.

A central portion of the pump 4 is illustrated in FIG. 2. The end members denoted by 7 and 8 of the pump are bolted to the motor 3 and the pipe string 5, respectively, as illustrated in FIG. 1. The end members 7 and 8 are threaded into the pipe housing 9. The end member 7 is provided with an opening 10 disposed directly opposite a radial inlet opening 11 to the interior of the housing 9, and the opening 10 is covered by a strainer 12 attached to the circular surface of the member 7.

The pump housing 9 is provided with a passage formed by three mutually intersecting cylindrical bores, the central one of which accommodates a drive screw 13, and both the outer bores accommodate running screws meshing with the drive screw, only one running screw 14 being illustrated in FIG. 2.

The passage formed by the bores extends with a constant cross-section through the entire housing 9 from one end to the other, one end being open towards a space 16 between the pump and motor and the other end being open towards a space 15 between the pump and the pipe string 5.

The drive screw 13 is made conventionally with convex threads and the running screws 14 with concave threads, the crests of the threads being sealingly surrounded by the bores with the threads sealing against each other. Between the threads and the housing there are thus formed mutually sealed chambers wherein oil is conveyed through the screw array. In the illustrated case the openings 10, 11 are at the downward end of the housing 9 in FIG. 1, which is the left-hand end in FIG. 2, and the screws rotate such that the oil is conveyed through the openings 10, 11 which communicate with the space between the pipe 1 and pump 4, the oil coming in radially and being conveyed by the screws towards the space 15 and further up through the pipe string 5 for further conveying via the means 2.

The unthreaded end portions of the running screws 14 form balancing pistons 22, which radially engage against the walls of the outer bores and form narrow gaps towards the axial surface of the drive screw end portion. The drive screw 13 is provided with a balancing piston 24 of the same diameter as the crests thereof and engaging radially against the wall of the central bore. The piston 24 is located outside the pistons 22 and its face 23 towards the drive screw thread is situated adjacent the faces 25 of the pistons 22 remote from the running screw threads so that a variable gap A is formed between them.

The drive screw 13 continues outside the balancing piston 24 with a shaft 20 which is journalled in a bearing 21 arranged in a part of the housing 9 formed as a cover 30. The shaft 20 is provided with splines for enabling removable coupling to the output shaft of the electric motor 3.

A balancing collar 26 is attached to the drive screw 13 adjacent the face of the balancing piston 24 remote from the drive screw. The left-hand (in FIG. 2) radial side of the collar 26, together with the cover 30, the axial surface of the drive screw 13 and wear ring 27 (on the cover 30) and 29 (on the collar 26), defines a first pressure chamber 28, and the radial side (to the right in FIG. 2) of the collar 26 defines, together with the axial surface of the balancing piston 24, the faces 25 of the balancing pistons 22 and the wall of the passage in the housing 9, a second pressure chamber 32.

The inlet of the first pressure chamber 28 is in communication with the pump outlet at 15 via an axial bore 36 through the drive screw and a radial bore 38 communicating therewith through the drive screw and opening out into the pressure chamber 28 at the axial surface of the drive screw. The outlet of the first pressure chamber 28 consists of a variable gap C between the wear rings 27 and 29.

The inlet to the second pressure chamber 32 comprises a through, axial hole 34 in the balancing collar 26 and the inlet at the gap C, which thus connects the first and second pressure chambers, while the outlet of the second pressure chamber 32 consists of the gap A.

Oil is introduced to the first pressure chamber 28 via the bores 36 and 38 at a pressure substantially corresponding to the outlet pressure at 15 of the pump, this pressure also acting on the substantially radial end surfaces of the screws 13 and 14, to the right in FIG. 2, and strives to displace the screws to the left in this FIGURE. The left, annular side surface of the collar 26, between the axial surface 13 of the drive screw and the wear ring 29, is greater than the combined radial sectional surfaces of the three bores in the housing 9, and therefore the oil pressure acting on this side surface strives to displace the drive screw to the right.

The gap C, which forms a hydrostatic bearing between the washer 26 and the housing part 30, will vary in width in response to the pressure in the pressure chamber 28 and in response to the axial forces acting on the drive screw. For an increased axial force to the left on the drive screw, the pressure in the pressure chamber 28 will increase, since the gap C becomes less, which results in that the drive screw via the collar 26 strives to return to the right.

There is a pressure in the second pressure chamber 32 substantially comprising the sum of the pressure at the low pressure or inlet side of the pump and the pressure provided by the communication, via the hole 34 and the gap C, with the first pressure chamber 28, which is also in communication with the high pressure or outlet side of the pump. The hole 34 is dimensioned such that the pressure in the pressure chamber 32 will always be so much greater than the axial pressure acting on the running screws 14 that the output flow gap A between the balancing pistons 22 and 24 is maintained and mechanical contact between their surfaces 23 and 25 is avoided. The dimension of the hole 34 may be regulatable for adjusting the pump to different operating conditions.

The screw machine in accordance with the invention has been described above in conjunction with pumping oil up out of a drill hole B, the electric motor 3 driving the screw array 13, 14 in one direction of rotation. However, the rotational direction of the electric motor is reversible for temporarily being able to reverse the rotational direction of the screw array so that oil is pumped in through the outlet (at 15) and out through the inlet (at 10, 11). Foreign matter which may have collected on the outside of the strainer 12, making it more difficult, or even preventing oil from being sucked in through the inlet 10, 11, is thus forced away from the strainer so that it becomes clear again. Due to the balancing described above, the screw array will not be subjected to unpermitted, large axial stresses during its rotation in the opposite direction.

By the implementation of, and co-action between, the different parts and pressure chambers of the machine, it is ensured that the screw machine described above may be used as a drill hole pump, in which the axial forces acting on the drive and running screws are balanced for ensuring an effective and reliable mode of operation under the special conditions existing in a deep drill hole.

Although only one embodiment of the invention has been described above and illustrated on the drawings, it will be understood that the invention is not limited to this embodiment, but only by the disclosures in the claims.

What is claimed as new and desired to be secured by Letters patent of the United States:

1. A hydraulic screw machine with an inlet at the low pressure side of the machine and an outlet including a screw array disposed inside a housing comprising a drive screw and at least one running screw co-acting therewith said drive screw being jointed to a shaft extending out of said housing at the low pressure side of the machine, said screws being provided at said low pressure side of said screw array with mutually co-acting balancing pistons adapted to hydraulically balance said screws against axial forces;

a balancing collar mounted on said drive screw, one radial side of said collar together with a part of said housing defining a first axially variable pressure chamber which is in communication with said outlet, the radial surface of said first pressure chamber being greater that the combined radial sectional surfaces of the screw bores in said housing in which said screws are accommodated;

the other radial side of said collar together with the balancing piston of said running screw, the balancing piston of said drive screw and a part of said housing defining a second axially variable pressure chamber which is in constricted communication with said outlet of the screw machine.

2. A screw machine as claimed in claim 1, wherein said constricted communication includes a through hole in said balancing collar.

3. A screw machine as claimed in claim 1, wherein the area of the constricted communication is dimensioned such that the leakage flow through it will be sufficiently large to maintain an outlfow gap between the drive screw balancing piston and the running screw balancing piston, which are thus kept mechanically separated.

4. A screw machine as claimed in claim 1, wherein the communication between said outlet of the screw machine and said first pressure chamber comprises an axial bore through said drive screw with a communicating radial bore through said drive screw opening out into said first pressure chamber.

5. A screw machine as claimed in claim 1, wherein the constricted communication is provided with adjusting means to be regulatable 6. A device for pumping oil or other fluid from a drill hole in the ground comprising:

a pump adapted to be lowered into the hole;

a drive motor situated under said pump and coupled thereto;

said pump comprising a hydraulic screw pump including a screw array mounted in a housing having an inlet and an outlet, said array being configurated as a drive screw provided with a shaft coupled to said drive motor and at least one running screw meshing with said drive screw;

said drive motor having a rotational direction such that said screw array pumps liquid from said inlet which extends radially through said housing in communication with the fluid in the drill hole to said outlet which is located at the end of said screw array remote from said shaft;

said screws at one end of said screw array being provided with mutually co-acting balancing piston adapted for hydraulically balancing said screws against axial forces;

a balancing collar mounted on said drive screw, one radial side of said collar together with a part of said housing defining an axially variable first pressure chamber which is connected in communication with said outlet of said pump, the other radial side of said collar together with the balancing piston of said running screw defining a second axially variable pressure chamber; and passage means placing said second pressure chamber in constricted communication with said outlet of said pump, said passage means including a hole extending through said balancing collar;

the pressure in said second pressure chamber tending to increase the distance between said drive screw and said running screw to fall to a pressure below the pressure in said first pressure chamber, the pressure in said first pressure chamber tending to reduce said distance.

* * * * *